United States Patent [19]

Hiester

[11] 4,280,245

[45] Jul. 28, 1981

[54] SOUND DOME FOR ELECTRIC VACUUM CLEANER

[75] Inventor: Kenneth R. Hiester, Cogan Station, Pa.

[73] Assignee: Shop-Vac Corporation, Williamsport, Pa.

[21] Appl. No.: 122,380

[22] Filed: Feb. 19, 1980

[51] Int. Cl.[3] ..... A47L 9/00

[52] U.S. Cl. ..... 15/326; 15/413; 55/276; 417/312

[58] Field of Search ..... 15/326, 413, 300 A; 55/276; 417/312

[56] References Cited

U.S. PATENT DOCUMENTS

| | | | |
|---|---|---|---|
| 3,780,397 | 12/1973 | Harbeck et al. | 15/413 |
| 3,815,172 | 6/1974 | Fromknecht et al. | 15/413 |
| 4,114,231 | 9/1978 | Nauta | 15/413 |

*Primary Examiner*—Christopher K. Moore

*Attorney, Agent, or Firm*—Ostrolenk, Faber, Gerb & Soffen

[57] ABSTRACT

The disclosure concerns a sound dome which is positioned over the motor housing of a bypass type vacuum cleaner. The main housing outlet for the main blower fan of the vacuum cleaner opens under the sound dome. The dome outlet from the sound dome is spaced away from the main housing outlet, causing the air from the main housing outlet to be redirected to the dome outlet. The motor housing has a tower portion that extends up into the sound dome. The housing has a cooling air inlet for cooling air to the motor, which is located higher up on the tower, and has a cooling air outlet for air that has cooled the motor, which is located lower on the tower. A baffle in the sound dome separates the cooling air inlet and the cooling air outlet. The enlarged plenum defined by the sound dome and the indirect pathway between the main housing outlet and the exit from the sound dome tend to reduce the noise generated by the vacuum cleaner.

9 Claims, 4 Drawing Figures

SOUND DOME FOR ELECTRIC VACUUM CLEANER

BACKGROUND OF THE INVENTION

The present invention relates to a tank or canister type electric vacuum cleaner and particularly to a sound dome for muffling the motor noise of such a vacuum cleaner.

In tank or canister type vacuum cleaners, the vacuum is generated by a blower fan which is driven by a motor. The motor, of course, generates noise and it is desirable to muffle the noise generated by the motor. The motor noise is principally heard at the main outlet for air that is blown by the blower fan. Accordingly, it is desirable to muffle the motor noise at that outlet. It is desirable to muffle the sound without appreciably interfering with the flow out of the vacuum cleaner, so as to not stress the blower motor or decrease the suction power of the vacuum cleaner.

Various sound muffling apparatus are, of course, known.

SUMMARY OF THE INVENTION

Accordingly, it is the primary object of the present invention to muffle the noise of a vacuum cleaner.

It is another object of the present invention to muffle the noise by enclosing the main blower fan outlet in a housing which muffles noise.

It is a further object of the present invention to muffle the noise of the vacuum cleaner without appreciably affecting the suction power of the vacuum cleaner.

The present invention is adapted principally for use with a canister or tank type vacuum cleaner where the vacuum cleaner motor is positioned at the lid of the vacuum cleaner. The invention is particularly adapted for use with a bypass flow type blow motor, which is a type of motor well known in the art. This type of motor has a main fan that draws the air through the vacuum cleaner inlet and that forces air through the vacuum cleaner outlet. It has an auxiliary fan which blows cooling air over the motor to cool it. Means keep the two air flows separate.

In the present invention, a bypass type of blow motor is located within a housing that is positioned atop the lid of the tank of a vacuum cleaner. Inlet to the vacuum cleaner is through an inlet opening in the tank, located below the lid. The main blower fan is a centrifugal fan, which sucks air out of the tank through a filter at the lid and then expels the air centrifugally of the fan and blows the air out the main blower fan outlet of the housing.

The blow motor housing has inlet openings for cooling air for the motor and spaced away from the inlet openings there are outlet openings for expulsion of motor cooling air.

The sound dome according to the present invention defines an enlarged plenum and the dome simply sits over the entire housing that includes the blow motor, the outlet from the main blower fan and the inlet and outlet for the motor cooling air flow. The dome simply sits on and is connected to the lid over the tank of the vacuum cleaner. The sound dome includes baffle means defining an enclosure for the cooling inlet openings to the motor, which enclosure communicates with the exterior of the dome, so that ambient air is drawn in for cooling the motor and this cooling air is kept separate from the higher temperature air which has been exhausted by the blower fan and the air which has been passed over the motor by the motor cooling fan. The flow exhausted from the vacuum cleaner main blower fan enters the plenum under the dome. In addition, it is contemplated that the outlets from the housing for the motor cooling air flow will also be exhausted into the same plenum. The plenum has an outlet opening to the environment, which is spaced away from the main blower fan outlet into the plenum, whereby the air exiting from the main blower fan outlet must travel a distance through an enlarged plenum which tends to reduce the velocity of the air and therefore reduces its noise and must also travel over a somewhat indirect pathway which also both slows the air and muffles the noise.

Other objects and features of the present invention will become apparent from the following description of a preferred embodiment of the invention which is taken in conjunction with the accompanying drawings.

DESCRIPTION OF A PREFERRED EMBODIMENT

Figure 1:
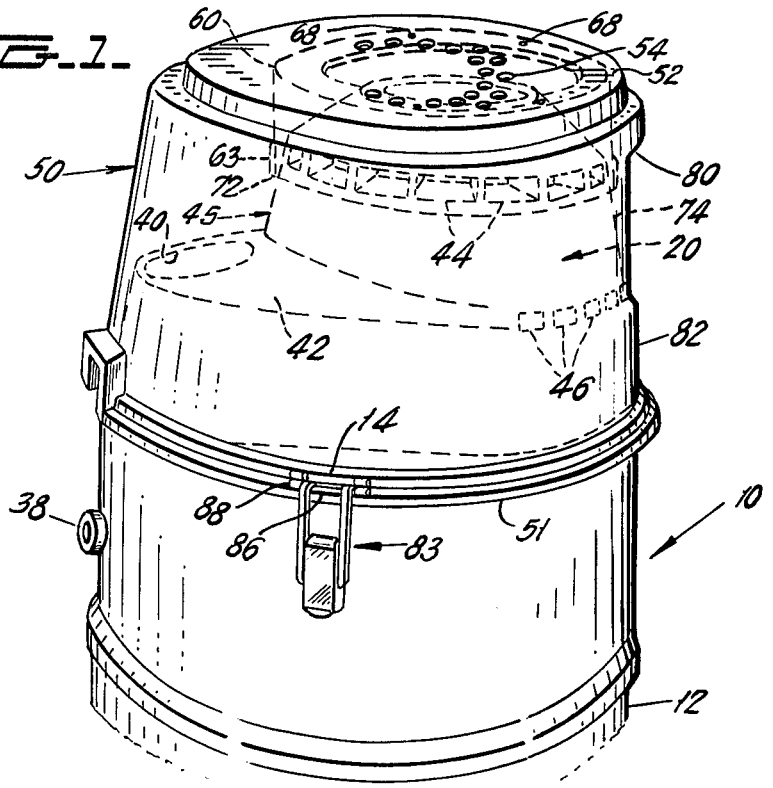
FIG. 1 is a perspective view of a vacuum cleaner fitted with a sound muffling dome according to the present invention.

A vacuum cleaner 10 with which the present invention is used comprises a simple tank or canister 12 having a lid 14 at its top. The lid is surmounted by an integral blow motor housing 20 of conventional design. A conventional bypass type electric blow motor 22 for use in such a vacuum cleaner is not shown in detail. The drive motor 22 is connected through a main drive shaft 24 with a centrifugal fan 26, which draws air into the fan from beneath the fan, and therefore from beneath the lid 14 through the filter 28 and out of the tank 12, and which emits the air centrifugally or from the side of the fan into the space inside the housing 20. The drive motor 22 is also connected with the drive shaft 32 which drives the cooling fan 34 to blow cooling air down over the motor 22. Appropriate baffles inside the housing 20 separate the various air flows and in particular separate the cooling air flowing to the fan 34 from the cooling air exhausted past the motor 22 and separate the main air flow exiting centrifugally from the main blower fan 26 from the cooling air flow.

The main air flow into the tank 12 is through the inlet nipple 38 to which a suction hose (not shown) is connected. The air flows up past the filter 28 and through the fan 26 and is blown by the fan 26 out the outlet hole 40 at the top of the section 42 of the housing 20.

Motor cooling air flow is through the annular array of openings 44 into the tower section 45 of the housing 20. Exit of cooling air that has blown down over the motor 22 is through the lower, arcuate array of outlet openings 46 at the bottom of the tower section 45.

The sound dome 50 according to the present invention is a simple, generally pot-shaped dome or housing of a diameter substantially the same as the diameter of the lid 14 so that the bottom 51 of the dome will seat at the periphery of the lid and of a height so that it will easily enclose over the top of the housing 20.

The top wall 52 of the lid has an array of holes 54 through it which permit entrance of cooling air to the cooling inlet opening array 44 in the housing 20.

Figure 2:
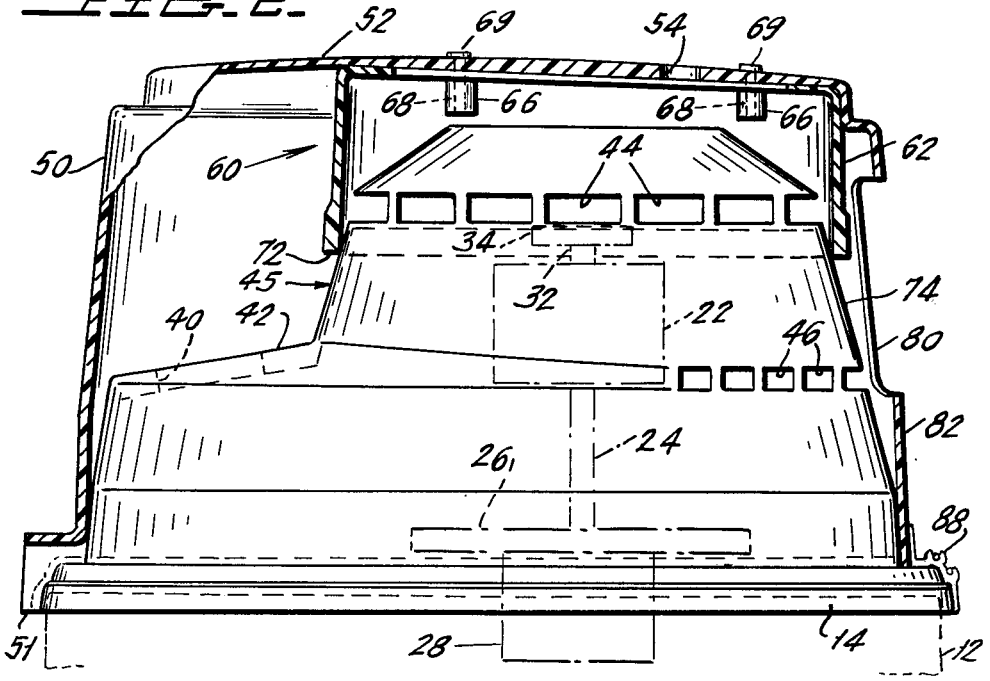
FIG. 2 is a side elevational view showing the sound dome broken away and showing the vacuum cleaner inside the sound dome.
Figure 3:
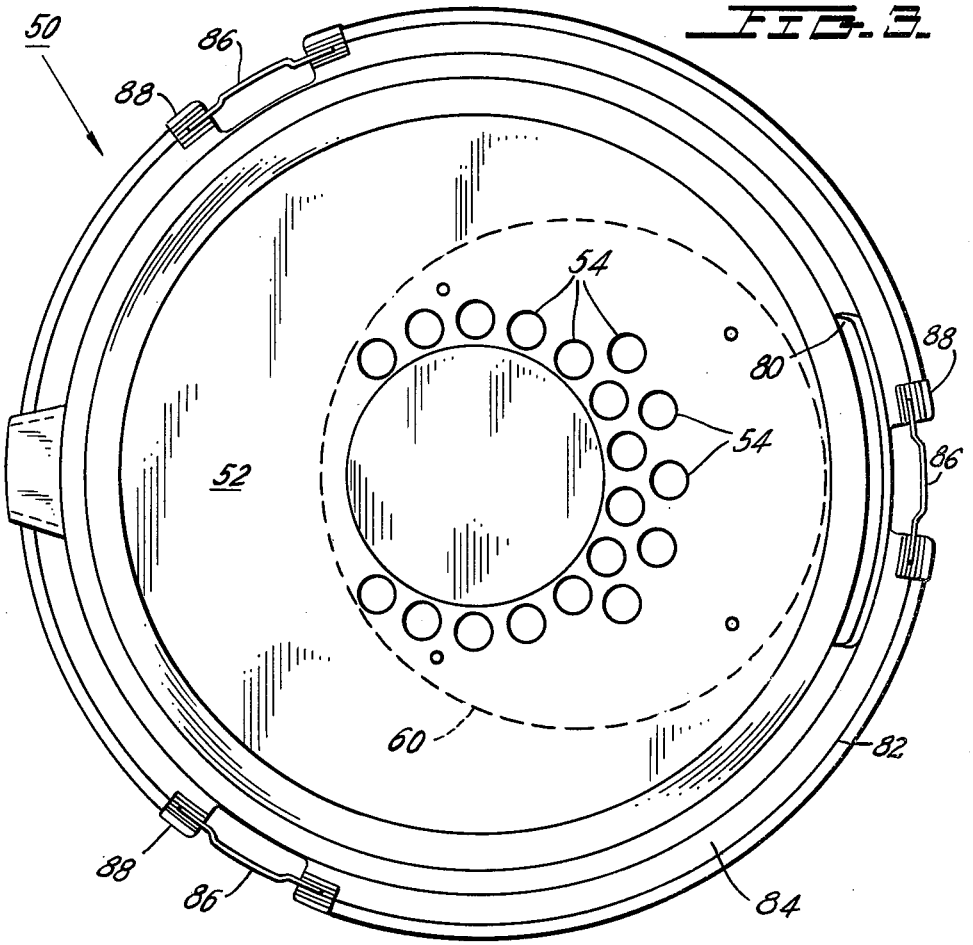
FIG. 3 is a top view of the sound dome.
Figure 4:
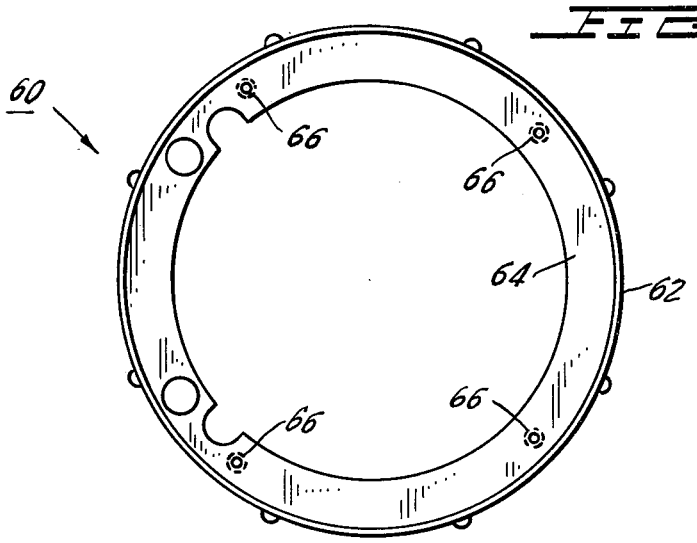
FIG. 4 is a plan view of an insert positioned in the sound dome for separating the cooling air inflow to the motor from the other air flows under the sound dome.

Disposed beneath the top wall 52 is the annular dome baffle 60 which has a depending annular side wall 62. These ribs or bosses are for molding purposes only. The top portion of the baffle 60 is an annular ring 64 of a thickness large enough to enable the baffle to be provided with fastening bosses 66 having holes therethrough which are aligned with fastening holes 68 in the top wall 52. Appropriate fastening means, e.g. screws 69 are provided for holding the baffle 60 inside the top wall 52 of the dome. As shown in FIG. 2, the baffle 62 is so placed and is of an axial length so that its bottom edge 72 around the entire periphery thereof rests against the side wall 74 of the housing 20 between the openings 44 and 46. Thus, the baffle 60 inside the dome 50 separates the cooling air inflow, on the one hand, from the plenum inside the sound dome, on the other hand. Cooling air to the motor therefore only enters the openings 44 from outside the sound dome through the openings 54 and inside the baffle 60.

The sound dome 50 has a single arcuate segment shaped, not very tall height opening 80 through its side wall 82 and located at the side of the sound dome that is opposite the side near which the main fan outlet opening 40 is located. The opening 80 is large enough so that it can readily pass all the air exiting through outlet 40 and also the exhausted cooling air exiting through outlets 46, without being so small as to resist the flow of air out the outlet 80, whereby the air flowing out of the outlet 80 need not travel at great velocity and no significant back pressure is developed, thereby not unduly stressing the drive motor 22. The opening 80 is at least larger than the outlet 40 for accomplishing these purposes. The position of the outlet 80 is such that air flowing out of the air outlet 40 from the housing 20 must be redirected to flow sideways by the top wall of the dome 52 and then must be redirected around a somewhat curving pathway to pass around the side wall 74 of the housing 20 and around the wall 62 of the baffle 60 in order for the exiting air to reach the outlet 80. This redirection of the air, coupled with the relatively larger size of the plenum under the dome into which the outlet 40 opens, coupled with the relatively larger size of the outlet 80, slows the velocity of the air exiting through the outlet 40, muffles the noise accompanying the exit of that air and makes the vacuum cleaner quiet in operation.

There are standard electric controls and power wires (not shown) for the drive motor 22. It is contemplated that these will be mounted on the housing 20 at wall 74 and facing outlet 80 so that easy access to the controls for the vacuum cleaner is also obtained through the outlet opening 80.

The dome 50 is intended to be attached to the tank 12 of the vacuum cleaner along with the lid 14 thereof. To this end, three conventional, equally spaced apart buckles 83 are provided. Each includes a hook 86 which hooks onto the lid 14. In addition, in order that the dome 50 will be held also, its bottom peripheral portion 84 supports three rigid wires 86 at respective fastening means 88 and the hooks 86 of the buckles 83 hook both the edge of the lid 14 and the respective wires 86. This holds the sound dome over the lid and holds the lid to the tank, forming the complete vacuum cleaner.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. In a bypass type vacuum cleaner, including a housing, said housing having a main outlet for air transported through the vacuum cleaner by a main blower fan, an inlet for cooling air to a motor for driving the main blower fan and an outlet for the cooling air from the main blower fan motor, a sound dome positioned over said housing and enclosing, under said sound dome, said main outlet, said cooling air inlet for the motor and said cooling air outlet; said sound dome being large enough to define a plenum under said sound dome for the air moving out of said main outlet; an outlet from said dome located away from said main housing outlet, whereby the air exiting from said main housing outlet will be redirected through said plenum to said dome outlet.

2. The sound dome of claim 1, wherein said dome outlet is larger in cross-section than said main housing outlet from said main blower fan, for reducing the velocity of air exiting through said dome outlet, as compared with the velocity of air exiting through said main housing outlet.

3. The sound dome of claim 1, wherein said cooling air outlet also communicates into said plenum.

4. The sound dome of claim 3, further comprising baffle means in said dome for separating the inflowing air to said cooling air inlet from the air from said cooling air outlet and said main housing outlet.

5. The sound dome of claim 4, wherein said baffle means and said dome together close access from said plenum into said cooling air inlet; said dome having separate inlet means therein enabling transmission of ambient air outside said dome to said cooling air inlet.

6. The sound dome of claim 5, wherein said sound dome is a generally pot-shaped dome and said housing extends up into said dome; said baffle means extending down from the closed wall of said pot-shaped dome to engage said housing between said cooling air inlet and said cooling air outlet, for separating the inflowing cooling air from the outflowing cooling air.

7. The vacuum cleaner of any of claims 1, 2, 5 or 6 further comprising means inside said sound dome for obstructing a straight line path between said main housing outlet and said dome outlet thereby causing the air exiting from said main housing outlet to be redirected around a non-straight pathway in traveling to said dome outlet said obstructing means including at least a portion of said housing.

8. The sound dome of claim 7, wherein said housing portion extends into said plenum.

9. The sound dome of claim 1, further comprising baffle means in said dome which together with said dome close access from said plenum into said cooling air inlet; said dome having separate inlet means therein enabling transmission of ambient air outside said dome to said cooling air inlet.

* * * * *